United States Patent [19]

Fehrer et al.

[11] 4,107,909

[45] Aug. 22, 1978

[54] APPARATUS FOR SPINNING TEXTILE FIBERS

[75] Inventors: Ernst Fehrer; Helmut Fuchs; Franz Konig, all of Linz, Austria

[73] Assignee: Dr. Ernst Fehrer Gesellschaft m.b.H. & Co., K.G., Linz, Austria

[21] Appl. No.: 757,587

[22] Filed: Jan. 7, 1977

[30] Foreign Application Priority Data

Apr. 8, 1976 [AT] Austria ..... 2568/76

[51] Int. Cl.[2] ..... D01H 1/12; D02G 3/36

[52] U.S. Cl. ..... 57/5; 57/58.95

[58] Field of Search ..... 57/5, 6, 50, 160, 58.89–58.95, 57/156; 19/150

[56] References Cited

U.S. PATENT DOCUMENTS

| | | | |
|---|---|---|---|
| 2,202,118 | 5/1940 | Newman et al. | 57/5 |
| 2,208,897 | 7/1940 | Dockerty et al. | 57/5 |
| 2,241,405 | 5/1941 | Hyde et al. | 57/5 |
| 3,636,693 | 1/1972 | Benson et al. | 57/50 X |
| 3,696,600 | 10/1972 | Mayer, Jr. et al. | 57/58.89 X |
| 3,913,310 | 10/1975 | Fehrer | 57/58.89 X |
| 3,972,173 | 8/1976 | Fehrer | 57/58.89 |
| 3,981,137 | 9/1976 | Fehrer | 57/58.89 X |

*Primary Examiner*—John Petrakes

*Attorney, Agent, or Firm*—Kurt Kelman

[57] ABSTRACT

A composite yarn is spun in a tapering gap between two suction drums which define suction zones adjoining the gap and facing each other. A yarn core is supplied to the gap between the facing suction zones from a bobbin at one end of the gap and flying fibers are supplied into the gap between the facing suction zones. Yarn drawoff rolls at the opposite end of the gap withdraw spun yarn while holding it against rotation, the flying fibers being twisted and wound around the yarn core in the gap between the facing suction zones to be spun into the composite yarn when the drums are rotated in the same sense.

1 Claim, 2 Drawing Figures

APPARATUS FOR SPINNING TEXTILE FIBERS

This invention relates to apparatus for spinning textile fibers comprising two perforated suction drums, which are disposed closely beside each other and rotate in the same sense and define between them a tapering gap which is adjoined by confronting suction zones, in which apparatus flying fibers enter the tapering gap and are twisted together therein to form a yarn, which is withdrawn from one end of the drum while being held against rotation.

This apparatus is known, e.g., from U.S. Pat. No. 3,913,310, and it is an object of the invention so to improve the apparatus that a yarn having a higher tensile strength can be made, yarn can be produced at a higher rate, and special yarns can be made, too.

This object is accomplished according to the invention in that a yarn core is drawn through the tapering gap from a source disposed at that end of the drums which is opposite to the end from which the yarn is withdrawn.

The yarn core may consist of a continuous filament or a yarn and is drawn throughout the length of the drums through the tapering gap.

It has been surprisingly found that fibers which fly freely into the tapering gap will twist or wind around a yarn core which consists of a continuous filament or a yarn and which is drawn throughout the length of the drums through the tapering gap. The resulting yarn consists of a core and of fibers spun around the core which may consist of a material that differs entirely from the material of the fibers. In any case, such yarn core adds to the tensile strength of the product yarn and the latter can be withdrawn at a higher speed because the fibers need no longer be twisted so tightly in producing the yarn but a lower twist is sufficient and will permit of a withdrawal at higher speed. Almost no structural alteration of the known apparatus is required. It is sufficient to provide a yarn core source, e.g., a bobbin of suitable size, before the two suctions drums and to draw the yarn core through an eyelet in order to ensure that the yarn core is properly guided through the tapering gap between the two suction drums.

Figure 1:
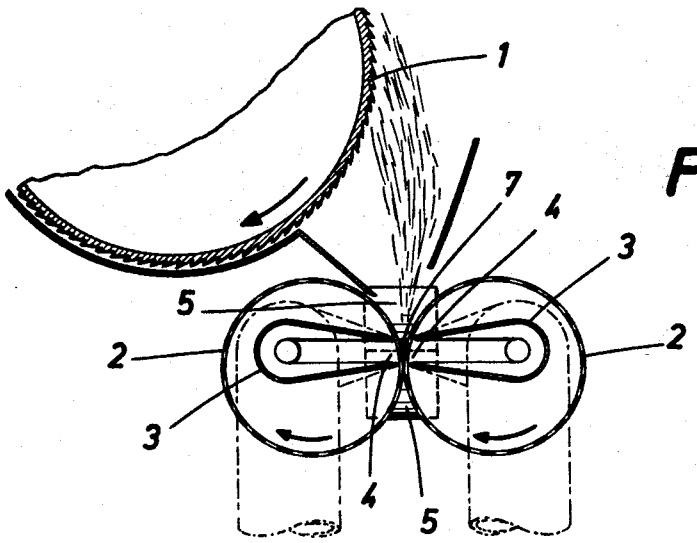
Figure 2:
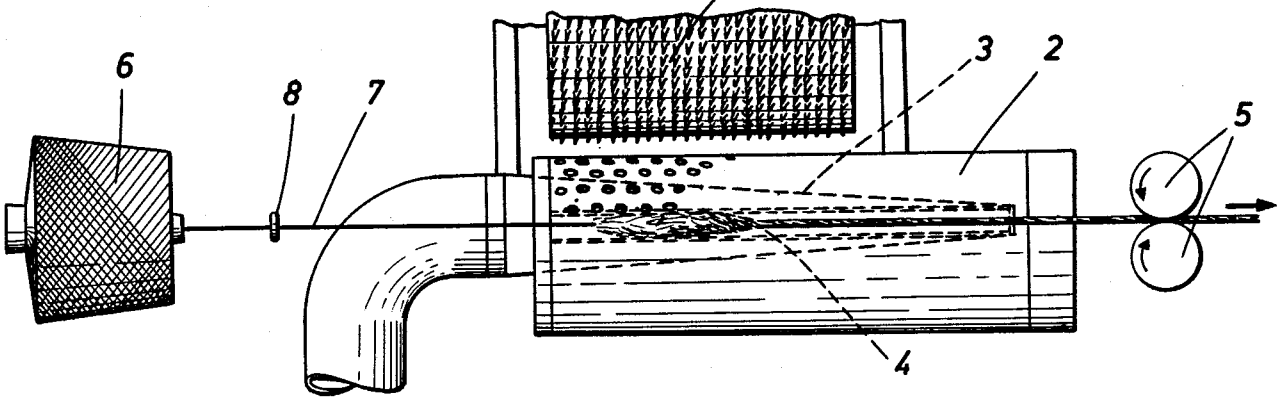

An illustrative embodiment of apparatus according to the invention is strictly diagrammatically shown on the accompanying drawing, in which FIG. 1 is a transverse sectional view on a plane that is normal to the axes of the suction drums and shows the essential parts of a spinning apparatus, and FIG. 2 is a side elevation showing the apparatus with the forward suction drum omitted.

From a serrated carding drum 1, the fibers fly into a tapering gap betwen suction drums 2 which lie closely beside each other and rotate in the same sense. Each suction drum is provided with a suction insert 3. The two suction inserts form respective suction zones 4, which adjoin the tapering gap and face each other. A pair of rolls 5 for withdrawing product yarn are provided at one end of the drum and hold the yarn against rotation.

In accordance with the invention, a bobbin 6 constituting a source of a yarn core 7 is provided at the other end of the drums. The yarn core 7 is withdrawn from the bobbin 6 through the tapering gap throughout the length thereof and through an eyelet 8 so that the fibers flying into the gap are twisted together and wound around the core 7 and the resulting yarn consists of a core and fibers spun around said core. The core may consist of a continuous filament or a yarn.

What is claimed is:

1. Apparatus for spinning textile fibers into a spun yarn, which comprises:

(a) two air-permeable suction drums having axes parallel to each other and disposed closely beside each other to define therebetween a tapering gap extending parallel to the axes of the drums, the drums being arranged to rotate in the same sense, (b) suction means defining on the peripheries of the suction drums respective air-permeable suction zones adjoining the gap and facing each other, (c) a source of a yarn core positioned adjacent one end of the gap and arranged to supply the yarn core to the gap between the facing suction zones and in a path parallel to the axes, the yarn core being twisted by the rotating drums about its axis in said gap, (d) means for supplying flying fibers into the gap between the facing suction zones, and (e) yarn withdrawing means positioned adjacent another end of the gap opposite the one end and arranged to draw off the spun yarn in said path while holding the spun yarn against rotation (1) whereby the flying fibers and the yarn core are spun into a yarn in the gap between the facing suction zones when the drums are rotated in the same sense.

* * * * *